US008459578B1

(12) United States Patent
Fischer

(10) Patent No.: US 8,459,578 B1
(45) Date of Patent: Jun. 11, 2013

(54) PRESCRIPTION LABEL IDENTITY PEELER

(76) Inventor: Troy Fischer, Gig Harbor, WA (US)

( * ) Notice: Subject to any disclaimer, the term of this patent is extended or adjusted under 35 U.S.C. 154(b) by 0 days.

(21) Appl. No.: 13/410,275

(22) Filed: Mar. 1, 2012

(51) Int. Cl.
*B31F 7/00* (2006.01)

(52) U.S. Cl.
USPC ..... 241/14; 241/99; 241/606; 156/153; 156/154; 451/12; 451/49; 451/106; 451/109; 451/178; 451/246; 451/324

(58) Field of Classification Search
None
See application file for complete search history.

(56) References Cited

U.S. PATENT DOCUMENTS

| | | | | | |
|---|---|---|---|---|---|
| 2,558,255 | A | * | 6/1951 | Johnson et al. | 241/99 |
| 3,713,596 | A | * | 1/1973 | Hoffmann | 241/99 |
| 3,938,745 | A | * | 2/1976 | Gladwin | 241/99 |
| 4,944,832 | A | | 7/1990 | Abe et al. | |
| 5,317,794 | A | | 6/1994 | Lerner et al. | |
| 5,372,317 | A | * | 12/1994 | Willis | 241/99 |
| 5,513,405 | A | | 5/1996 | Bradbury, Jr. et al. | |
| 5,620,146 | A | * | 4/1997 | Lukas | 241/99 |
| 5,679,210 | A | | 10/1997 | Thomas | |
| 5,718,030 | A | | 2/1998 | Langmack et al. | |
| 7,546,965 | B1 | * | 6/2009 | Parkin | 241/99 |
| 7,673,825 | B2 | * | 3/2010 | Jeansonne et al. | 241/100 |
| D613,473 | S | | 4/2010 | Pierce | |
| 7,823,814 | B2 | * | 11/2010 | Sued et al. | 241/30 |
| 7,832,666 | B2 | * | 11/2010 | Montgomery et al. | 241/27 |
| 7,959,096 | B1 | | 6/2011 | Wells, Sr. | |
| 2009/0007737 | A1 | | 1/2009 | Pierce | |
| 2010/0276083 | A1 | | 11/2010 | Hurst | |
| 2011/0011962 | A1 | * | 1/2011 | Abramson et al. | 241/30 |

* cited by examiner

*Primary Examiner* — Mark A Osele
*Assistant Examiner* — Nickolas Harm
(74) *Attorney, Agent, or Firm* — Thien Tran, Esq.; Access Patent Group, LLC

(57) ABSTRACT

A prescription label identity peeler includes a box-shaped housing. A lid extends over the box-shaped housing. A sanding member is adjustably carried within the box-shaped housing. A pair of linkage arms is pivotally extend between the lid and the sanding member. The motorized linkage arms will move the sanding member simultaneously and horizontally against the empty pill bottle in an inverted position, while the wheel on the swing arm assembly will contact a bottom end of the empty pill bottle via compression of the springs, thereby removing the label from the empty pill bottle when the inverted empty pill bottle rotates.

7 Claims, 3 Drawing Sheets

PRESCRIPTION LABEL IDENTITY PEELER

BACKGROUND OF THE INVENTION

1. Field of the Invention

The present invention relates to a pill bottle label remover, and more particularly, a prescription label identity peeler.

Many individuals throw away a prescription pill bottle with the label still attached to it. The label displays the person's personal information, such as their name, address, phone number, physician, as well as their medication information. If the bottle falls into the hands of a criminal, a person's identity may be at risk. It can be difficult to remove the label. It often does not peel off all the way, and individuals waste a great deal of time trying to remove the entire label and it's adhesive. The bottle cannot be reused or recycled if the label is not properly removed. A more efficient way is needed.

The prescription label identity peeler is a device designed to remove the label from a prescription pill bottle. The present invention can be used by anyone who takes medication and wants to remove their personal information from the bottle before they discard it. The peeler product provides security and convenience and ensures that an individual's private information does not end up in the wrong person's hands. The present invention is easy to use and assists individuals in protecting their identity.

2. Description of the Prior Art

Numerous innovations for delabeling devices have been provided in the prior art that will be described. Even though these innovations may be suitable for the specific individual purposes to which they address, however, they differ from the present invention.

A FIRST EXAMPLE, U.S. Pat. No. 4,944,832, Issued on Jul. 31, 1990, to Abe et al. teaches a label peeler for peeling off a label attached to a side of a container such as a bottle includes a holder for holding the container, label scraping means for scraping the label off the container by effecting sliding movement in intimate contact with the side of the container, and driving means for varying the relative position of the container and the label scraping means to remove the label from the side of the container. With the container being held by the holder, the holder or the label scraping means or both are moved to vary the relative position of the container and the label scraping means while keeping the label scraping means in close contact with the side of the container, for thereby mechanically peeling the label off the container.

A SECOND EXAMPLE, U.S. Pat. No. 5,317,794, Issued on Jun. 7, 1994, to Lerner et al. teaches a machine for removing tubular plastic labels from bottles to facilitate their re-use and recycling. The machine has a multi-station turret and supply and exit conveyors to sequentially supply labeled bottles in line to the turret and remove delabeled bottles from the turret. The delabeling is accomplished with a cutter which is preferably in the form of a high-pressure jet of water. Ideally, the cutter is adjusted so that it is a differential cutter which will cut a label without cutting or marring a bottle from which a label is being removed. With one embodiment, a water flush mechanism is provided to flush cut labels from their bottles and the turret onto a screen conveyor. The flush water passes through the conveyor into a container from which it is pumped for re-use. Removed labels are transported by the screen conveyor to a collection bin. With another embodiment, an air blast mechanism is used to strip cut labels from bottles and a vacuum pick up is used to collect stripped labels.

A THIRD EXAMPLE, U.S. Pat. No. 5,513,405, Issued on May 7, 1996, to Bradbury Jr. et al. teaches a multipurpose combination-tool (for recyclers) which performs the functions of removing staples, scraping, identifying steel from other metallic recyclables like aluminum, cutting cardboard into dimensions appropriate for baling, removing plastic or metal cap retainer rings, stripping non-glued labels, cutting baling cord and various carton types, and removing pre-softened glue labels from bottles. The tool includes a scraper, a retractable hooked-shaped blade, a straight blade, a magnet, a passage way in the scraper, a housing with a comfortable grip and one set of extra blades stored in the housing.

A FOURTH EXAMPLE, U.S. Pat. No. 5,679,210, Issued on Oct. 21, 1997, to Thomas teaches a hand held label removal apparatus which provides a safe, reliable means for removing labels and safety seals from containers. A trigger actuated needle like cutter is manually exposed to penetrate the surface of a label and thereby remove it from the surface of a container. In addition, the cutter may be used to remove foil seals and plastic packaging found on many consumer packaging. Designed to be made from various colors of plastic, the apparatus provides a simple, inexpensive means for the user to remove labels from recyclable containers. Also, when the label is not in use, the cutter automatically retracts, thereby, preventing accidental harm to a person.

A FIFTH EXAMPLE, U.S. Pat. No. 5,718,030, Issued on Feb. 17, 1998, to Langmack et al. teaches a dry abrasive delabeling apparatus for both plastic and glass bottles, sometimes called a label stripper, in which the bottles are fed by an in-feed starwheel to a circular starwheel which rotates the bottles slowly. Within the starwheel are wire bristle brushes rotating at a high speed against the bottles to flick off paper, foil, or plastic from the label on the bottle while restraining the bottle in close contact to the ends of the wire bristle by means of a rubber bladder to press against the bottles. The bottles are held against the wire bristles while the bottles are rotated as they are held against the bladder. The debris is vacuumed away from the apparatus.

A SIXTH EXAMPLE, U.S. Patent Office Publication No. 2009/0007737, Published on Jan. 8, 2009, to Pierce teaches a device for removal of a layer, such as a label, from a cylindrical surface of an object. The device includes a guide, a cutting instrument, and a base connecting the guide and the cutting instrument. The guide and the cutting instrument are separated by a distance defined by the base, and the cutting instrument is positioned to shave along the object's surface to remove the layer, when the surface of the object is rotated against the cutting instrument and against the guide. The method includes, positioning an object in a device having a cutting instrument and a guide, where the cutting instrument and the guide both support the object, and where the cutting instrument is positioned to shave along the surface to remove the layer when the object is rotated; and rotating the object so the cutting instrument shaves under the layer to remove the layer.

A SEVENTH EXAMPLE, U.S. Pat. No. D613,473, issued on Apr. 6, 2010, to Pierce teaches an ornamental design for a bottle label removal apparatus, as shown.

AN EIGHTH EXAMPLE, U.S. Patent Office Publication No. 2010/0276083, published on Nov. 4, 2010, to Hurst teaches an improved semi-automatic Label Stripping Machine for detaching labels from a round container. The container is placed between a rotatable idler and a rotatable platform. The container is rotated on its central vertical axis by rotating the platform. A plurality of peeler assemblies are brought in contact with the label and are moved down the outside surface of the container there by spirally striping off the label. The apparatus further comprises a guide that provides improved safety and a self-cleaning feature.

A NINTH EXAMPLE, U.S. Pat. No. 7,959,096, Issued on Jun. 14, 2011, to Wells Sr. teaches a shredder that will prevent a lot of injuries from people trying to scrap information off the bottle with a sharp object. It would be made of parts right here in the United States and of communally used parts. The invention will be child proof but most of all the cost to build would be minimal so it would be very affordable for the majority of Americans.

It is apparent now that numerous innovations for delabeling devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a prescription label identity peeler that avoids the disadvantages of the prior art.

ANOTHER OBJECT of the present invention is to provide a prescription label identity peeler that is simple and inexpensive to manufacture.

STILL ANOTHER OBJECT of the present invention is to provide a prescription label identity peeler that is simple to use.

BRIEFLY STATED, STILL YET ANOTHER OBJECT of the present invention is to provide a prescription label identity peeler comprises a box-shaped housing. A lid extends over the box-shaped housing. A sanding member is adjustably carried within the box-shaped housing. A pair of linkage arms pivotally extends between the lid and the sanding member. A motor is vertically retained within the box-shaped housing. A roller grip assembly is vertically retained within the box-shaped housing to receive an inverted empty pill bottle having a label thereon. A gear assembly within the box-shaped housing extends between the motor and the roller grip assembly. A swing arm assembly is hinged rearwardly to the lid. A wheel is rotatably mounted to a forward end of the swing arm assembly. A pair of springs extends between the lid and the swing arm assembly. A normally open safety switch mounted within the box-shaped housing is electrically connected between the motor and a power source. A peg affixed to the underside of the lid. When the lid is closed over the box-shaped housing, the peg will make contact with the safety switch to turn on the motor, to cause the gear assembly to rotate the roller grip assembly. The linkage arms will move the sanding member simultaneously and horizontally against the empty pill bottle (in an inverted position), while the wheel on the swing arm assembly will contact a bottom end of the empty pill bottle via compression of the springs, thereby removing the label from the empty pill bottle when the empty pill bottle rotates.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

110 prescription label identity peeler
112 box-shaped housing of peeler 110
114 lid of peeler 110
116 sanding member of peeler 110
118 linkage arm of peeler 110
120 motor of peeler 110
122 roller grip assembly of peeler 110
124 empty pill bottle
126 label on empty pill bottle 124
128 gear assembly of peeler 110
130 swing arm assembly of peeler 110
132 wheel of peeler 110
134 spring of peeler 110
136 safety switch of peeler 110
138 power cord of peeler 110
140 peg of peeler 110
142 bottom end of empty pill bottle 124

DETAILED DESCRIPTION OF THE PREFERRED EMBODIMENT

Figure 1:
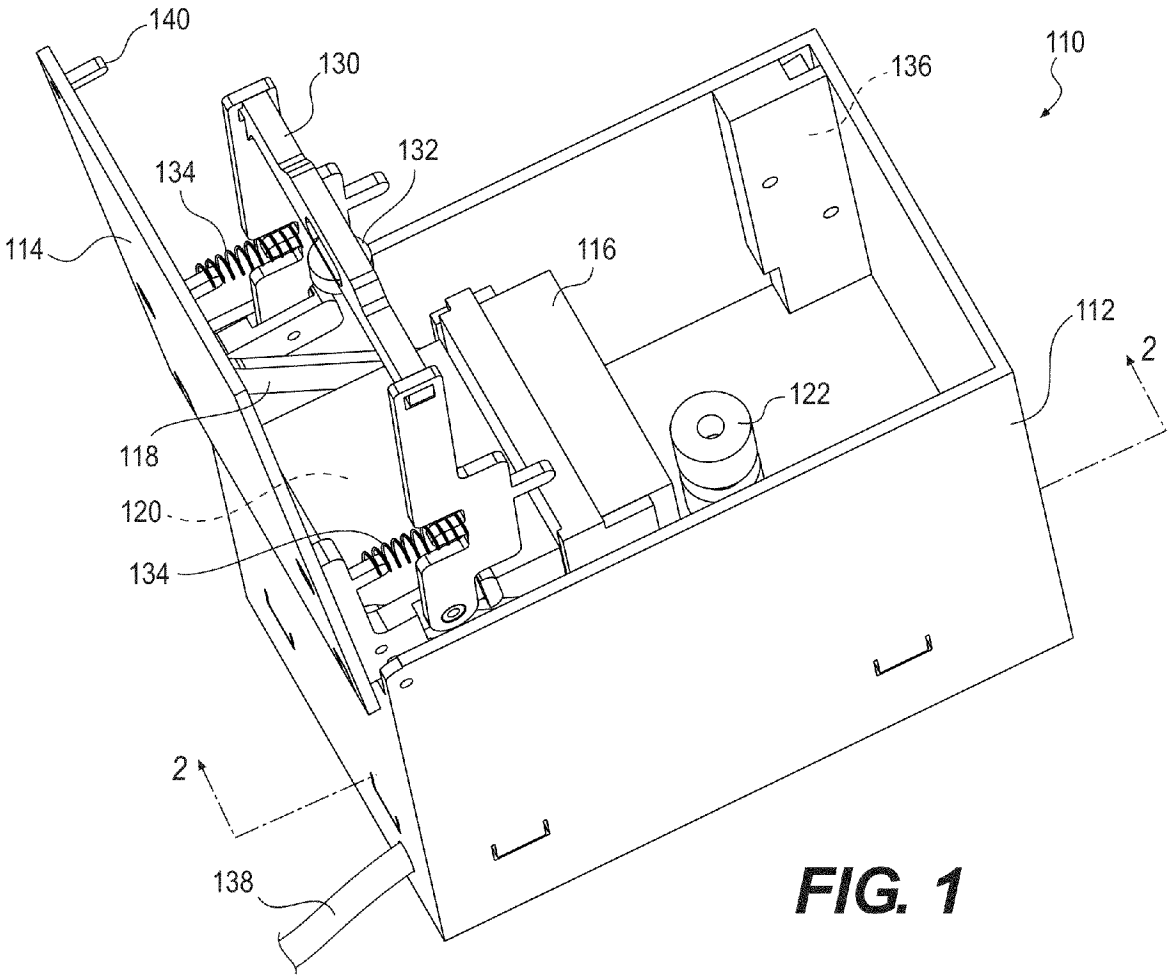
FIG. 1 is a diagrammatic perspective view of the present invention with the lid in an open position.
Figure 2:
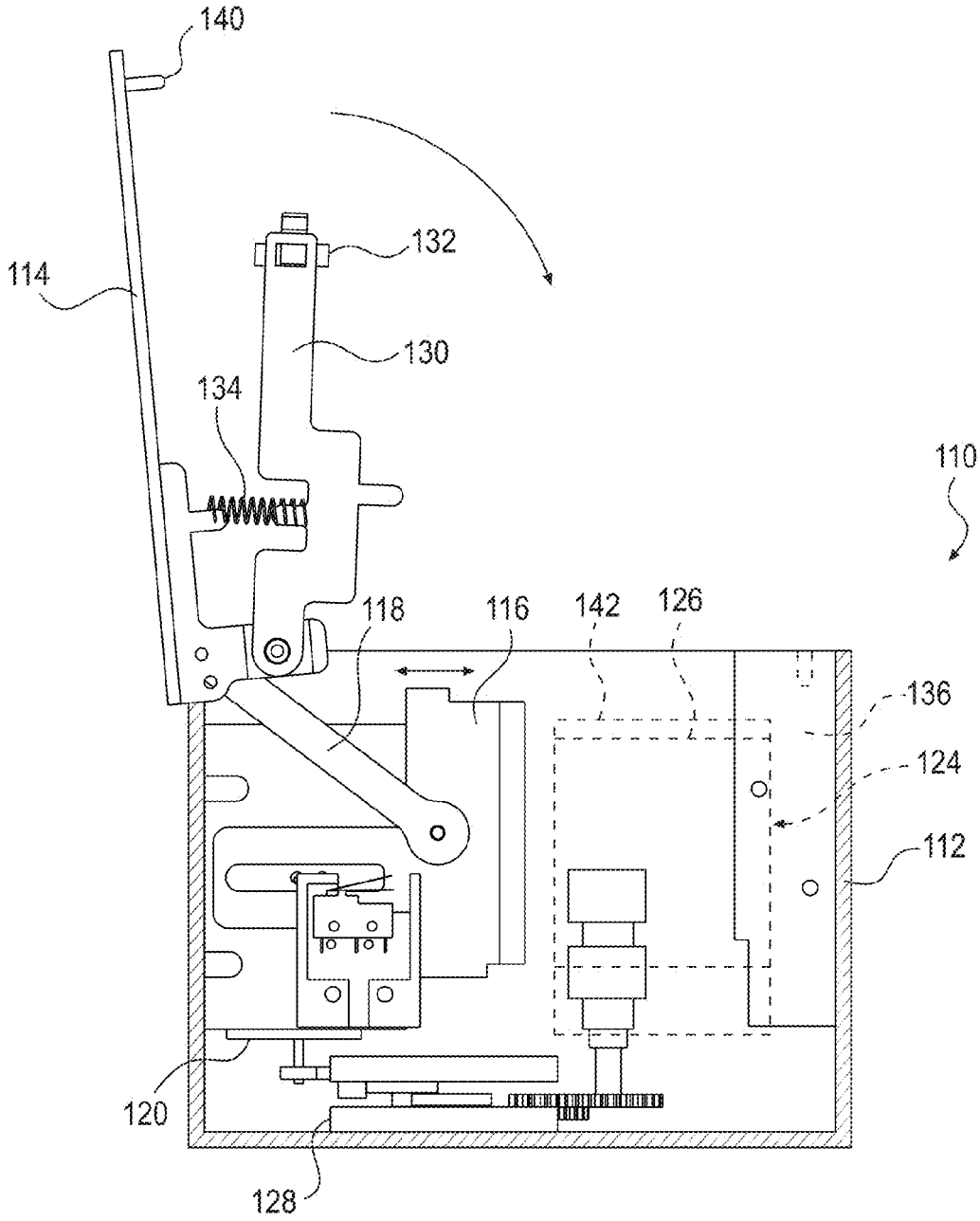
FIG. 2 is a diagrammatic cross sectional view taken along line 2-2 in FIG. 1.

As shown in FIGS. 1 and 2, the present invention is a prescription label identity peeler 110 which comprises a box-shaped housing 112. A lid 114 extends over the box-shaped housing 112. A sanding member 116 is adjustably carried within the box-shaped housing 112. A pair of linkage arms 118 is pivotally extends between the lid 114 and the sanding member 116.

A motor 120 is vertically retained within the box-shaped housing 112. The motor 120 operates under 120 Volts AC. A roller grip assembly 122 is vertically retained within the box-shaped housing 112 to receive an inverted empty pill bottle 124 having a label 126 thereon. A gear assembly 128 within the box-shaped housing 112 extends between the motor 120 and the roller grip assembly 122. A swing arm assembly 130 is hinged rearwardly to the lid 114.

A wheel 132 is rotatably mounted to a forward end of the swing arm assembly 130. A pair of springs 134 extends between the lid 114 and the swing arm assembly 130. A normally open safety switch 136 mounted within the box-shaped housing 112 is electrically connected between the motor 120 and a power source via a power cord 138 (e.g. 120 Volts AC from an outlet, 12 VDC, 24 VDC, . . . ). A peg 140 is affixed to the underside of the lid 114.

Figure 3:
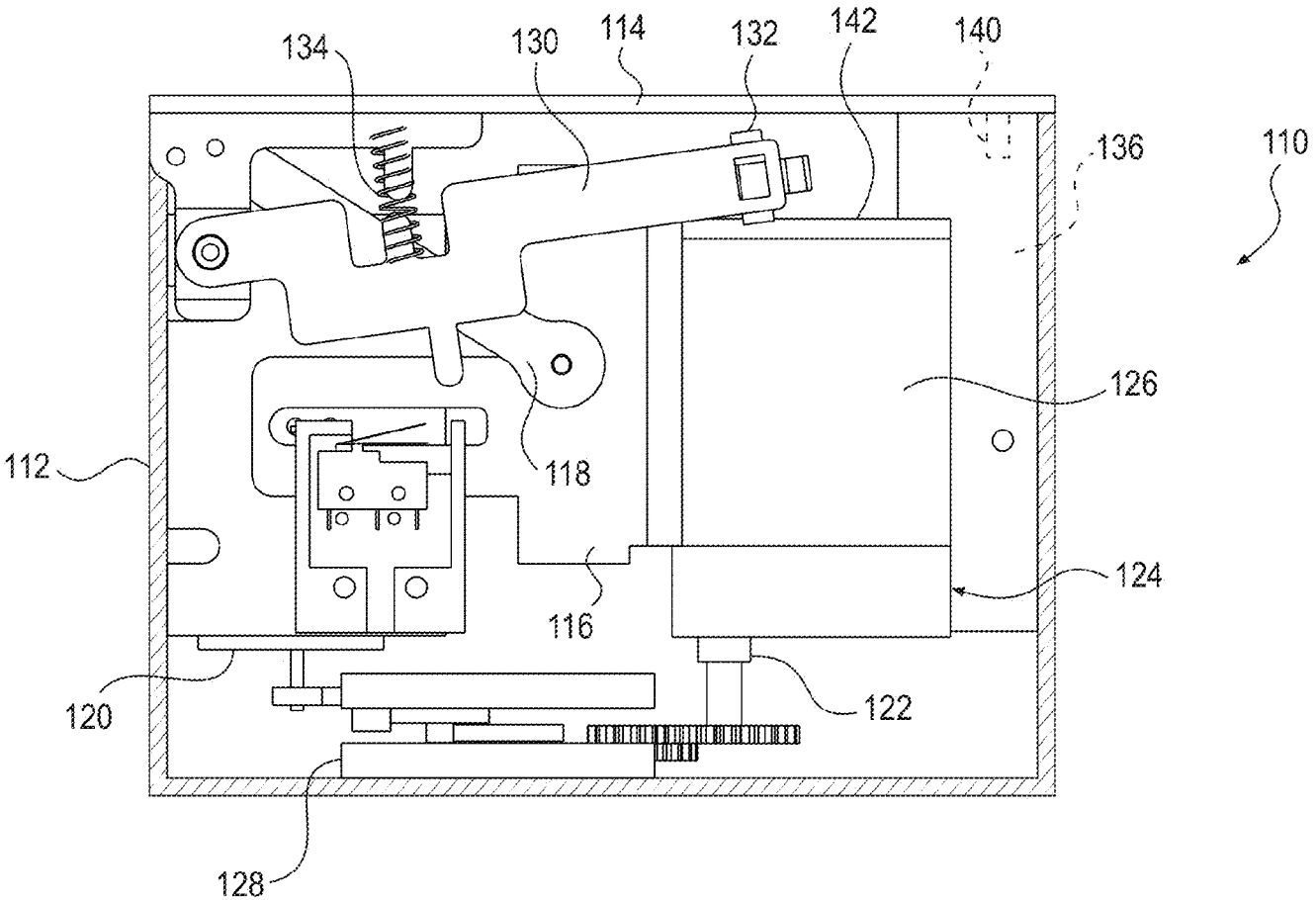
FIG. 3 is a diagrammatic cross sectional view similar to FIG. 2, with an inverted empty pill bottle therein and the lid in a closed position.

As shown in FIG. 3, when the lid 114 is closed over the box-shaped housing 112, the peg 140 will make contact with the safety switch 136 to turn on the motor 120. This will cause the gear assembly 128 to rotate the roller grip assembly 122. The linkage arms 118 will move the sanding member 116 simultaneously and horizontally against the empty pill bottle 124 (in an inverted position for easy gripping on the cap of the pill bottle 124), while the wheel 132 on the swing arm assembly 130 will contact a bottom end 142 of the empty pill bottle 124 via compression of the springs 134, thereby removing the label 126 from the empty pill bottle 124 when the inverted empty pill bottle 124 rotates. The box-shaped housing 112 is approximately six and a half inches in length by four and a quarter inches in width and by five and a quarter inches in height. The box-shaped housing 112, gear assembly 128 and the lid 114 are fabricated out of a plastic material. The motor 120, and springs 134 are fabricated out of a metal material.

It will be understood that each of the elements described above, or two or more together, may also find a useful application in other types of constructions differing from the types described above.

While the invention has been illustrated and described as embodiments of a prescription label identity peeler, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A prescription label identity peeler which comprises:

a) a box-shaped housing having a bottom and side walls;

b) a lid extending over the box-shaped housing;

c) a sanding member within the box-shaped housing;

d) a pair of linkage arms pivotally extending between the lid and the sanding member;

e) a motor vertically retained within the box-shaped housing;

f) a roller grip assembly vertically retained within the bottom of the box-shaped housing to receive an inverted empty pill bottle having a label thereon;

g) a gear assembly within the box-shaped housing extending between the motor and the roller grip assembly;

h) a swing arm assembly hinged to the lid;

i) a wheel rotatably mounted to a forward end of the swing arm assembly;

j) a pair of springs extending between the lid and the swing arm assembly;

k) a normally open safety switch mounted within the box-shaped housing and electrically connected between the motor and a power source; and l) a peg affixed to the underside of the lid, whereby when the lid is closed over the box-shaped housing, the peg will make contact with the safety switch to turn on the motor, to cause the gear assembly to rotate the roller grip assembly and thereby rotate the pill bottle, the linkage arms will move the sanding member horizontally against the empty pill bottle, while the wheel on the swing arm assembly will contact a bottom end of the empty pill bottle via compression of the springs, thereby removing the label from the empty pill bottle when the inverted empty pill bottle rotates.

2. The prescription label identity peeler as recited in claim 1, wherein the box-shaped housing is approximately six and a half inches in length by four and a quarter inches in width and by five and a quarter inches in height.

3. The prescription label identity peeler as recited in claim 1, wherein the box-shaped housing, gear and the lid are fabricated out of a plastic material.

4. The prescription label identity peeler as recited in claim 1, wherein the motor, and springs are fabricated out of a metal material.

5. The prescription label identity peeler as recited in claim 1, wherein the motor is run under 120 Volts AC.

6. The prescription label identity peeler as recited in claim 1, wherein the motor is run under 12 Volts DC.

7. The prescription label identity peeler as recited in claim 1, wherein the motor is run under 24 Volts DC.

* * * * *